United States Patent [19]

Fahey et al.

[11] Patent Number: 4,750,649

[45] Date of Patent: Jun. 14, 1988

[54] RECOVERY BOILER SMELT SPOUT

[75] Inventors: Colby Fahey, Ticonderoga; Minas A. Souris, Westport; Francis Navojosky; Lester Pedron, both of Ticonderoga, all of N.Y.; Arthur Young, Wilton, Me.; Wayne MacIntire, Ticonderoga, N.Y.

[73] Assignee: International Paper Company, Purchase, N.Y.

[21] Appl. No.: 71,967

[22] Filed: Jul. 10, 1987

[51] Int. Cl.[4] ..... B22D 35/06; B67D 5/62

[52] U.S. Cl. ..... 222/592; 222/590

[58] Field of Search ..... 122/6.5, 4 R; 222/590, 222/591, 592

[56] References Cited

U.S. PATENT DOCUMENTS

| | | |
|---|---|---|
| 138,184 | 4/1873 | Pearse . |
| 1,625,755 | 4/1927 | Williams et al. . |
| 1,796,644 | 3/1931 | Carrington . |
| 1,848,072 | 3/1932 | Clark . |
| 2,225,660 | 12/1940 | Rogers . |
| 3,284,860 | 11/1966 | Gurak . |
| 3,713,639 | 1/1973 | Von Starck et al. ..... 222/592 X |
| 4,177,974 | 12/1979 | Higuchi et al. . |
| 4,303,230 | 12/1981 | Bleloch . |
| 4,426,067 | 1/1984 | Hopkins . |
| 4,446,995 | 5/1984 | Wooding . |
| 4,498,610 | 2/1985 | Wooding . |

*Primary Examiner*—Edward G. Favors

*Attorney, Agent, or Firm*—Walt Thomas Zielinski

[57] ABSTRACT

A spout for a recovery boiler such as those used in the papermaking industry. As in prior art spouts of this type, the spout is provided with an internal cavity to thereby permit water cooling of the spout. By this invention, a duct is provided for the internal cavity, the duct applying a portion of the coolant liquid to specific areas of the spout which in the past have failed. Further, the radius of curvature of the lowermost portion of the spout is increased by a factor of two. The useful life of the spout of this invention is in excess of twenty five weeks, as compared to a prior art spout whose useful life is about two weeks.

7 Claims, 2 Drawing Sheets

RECOVERY BOILER SMELT SPOUT

BACKGROUND OF THE INVENTION

This invention relates to a spout for recovery boilers, such boilers being used in the papermaking industry.

During normal recovery boiler operation, the lower part of the boiler furnace is filled with hot, molten liquid. This liquid continually empties from the recovery boiler by means of a spout. Typically, a spout will last about two weeks due, it is believed, to degradation of the spout by the high temperture of the molten liquid. Replacement of the spout not only entails the cost of a spout, but shut-down time of the recovery boiler because the boiler cannot operate while the spout is being replaced.

In order to lessen the deleterious effects of high temperature caused by contact with the molten liquid, such spouts have been water cooled. This is effected by providing the spout with an internal cavity, wherein a coolant liquid, such as water, is fed into the hollow spout and is then led away from the interior of the spout for cooling and subsequent recirculation. U.S. Pat. No. 1,625,755 issued to Williams shows a water cooled smelter spout formed of two semi-cylindrical sections and joined together in such a manner as to define a coolant cavity between them. The cavity is in fluid communication with an inlet pipe or tube and an outlet tube.

Another prior art water cooled boiler spout has been marketed by Babcox and Wilcox Company and includes a spout having a main or forward internal cavity and also having a rear cavity, the rear cavity defined by a housing portion adapted to mount on the lower furnace of the recovery boiler. This spout is mounted in such a way that the molten smelt exiting the recovery boiler flows through the spout trough. This has been used prior to this invention but has exhibited the drawback of breaking down approximately every two weeks, such breakdown believed to be due to thermal metal fatigue caused by concentration of heat at one or more portions of the spout.

SUMMARY OF THE INVENTION

According to the practice of this invention, a new design spout has been constructed so as to include a duct for the coolant liquid, the duct applying a portion of the coolant liquid to specific areas of the boiler spout which have in the past failed. It has been found that the design of this invention yields of water-cooled boiler spout having a life in excess of 25 weeks, as opposed to the prior art useful life of about two weeks.

The lower portion of the spout coolant cavity is provided with a duct or closed passageway, the duct extending from a front to a rear portion of the spout, the duct defining a separate passageway within the coolant cavity and serving to direct a portion of the coolant liquid to a selected part of the spout interior to thereby inhibit the build up of temperature in an otherwise stagnant zone of the coolant liquid. Further, the radius of curvature of the lowermost portion of the spout is increased by more than a factor of two. Still other departures in construction from the prior art will be later set forth.

DETAILED DESCRIPTION OF THE INVENTION

Figure 1:
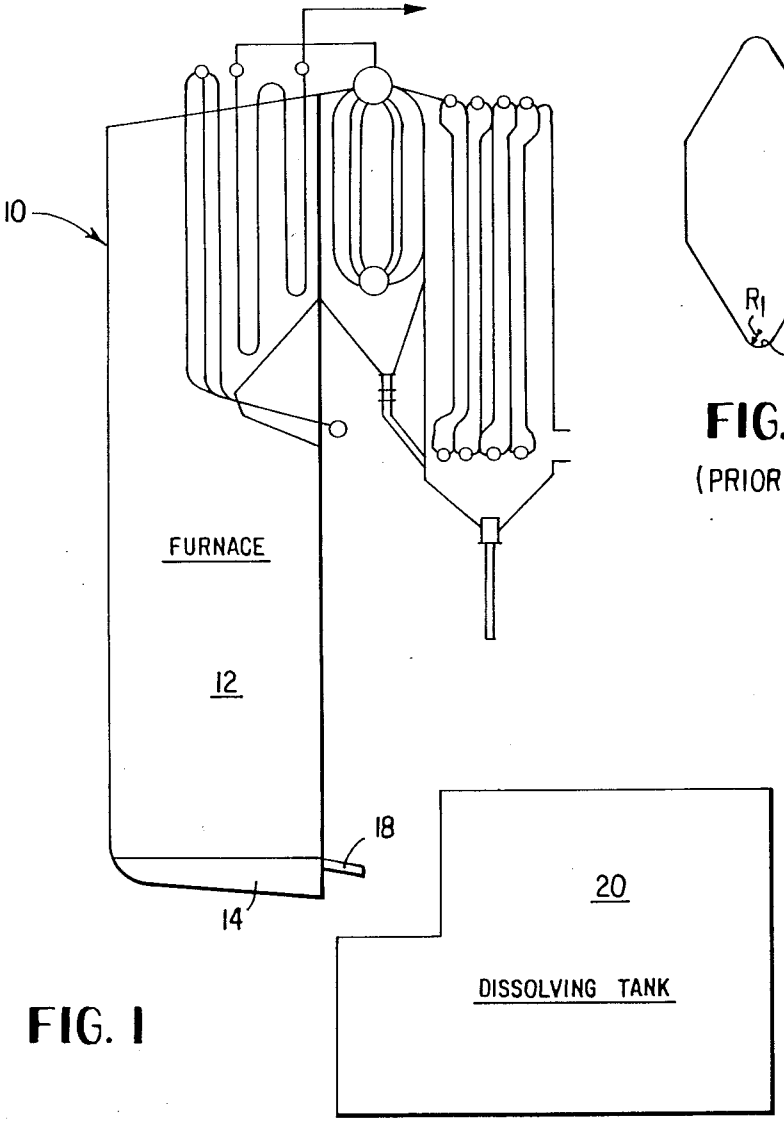
FIG. 1 is a partially schematic view of a typical recovery boiler and shows the location of the spout of this invention.

Referring now to FIG. 1, the numeral 10 denotes generally a recovery boiler used in papermaking and includes a furnace 12 which contains a quantity of liquid smelt 14 in its bottom. The remainder of the interior of furnace 12 contains fumes. The smelt and fumes are at elevated temperatures. The numeral 18 denotes generally the boiler spout of this invention, the spout emptying the hot smelt into a dissolving tank 20. The details of construction of the recovery boiler and of the dissolving tank are not part of this invention.

Figure 2:
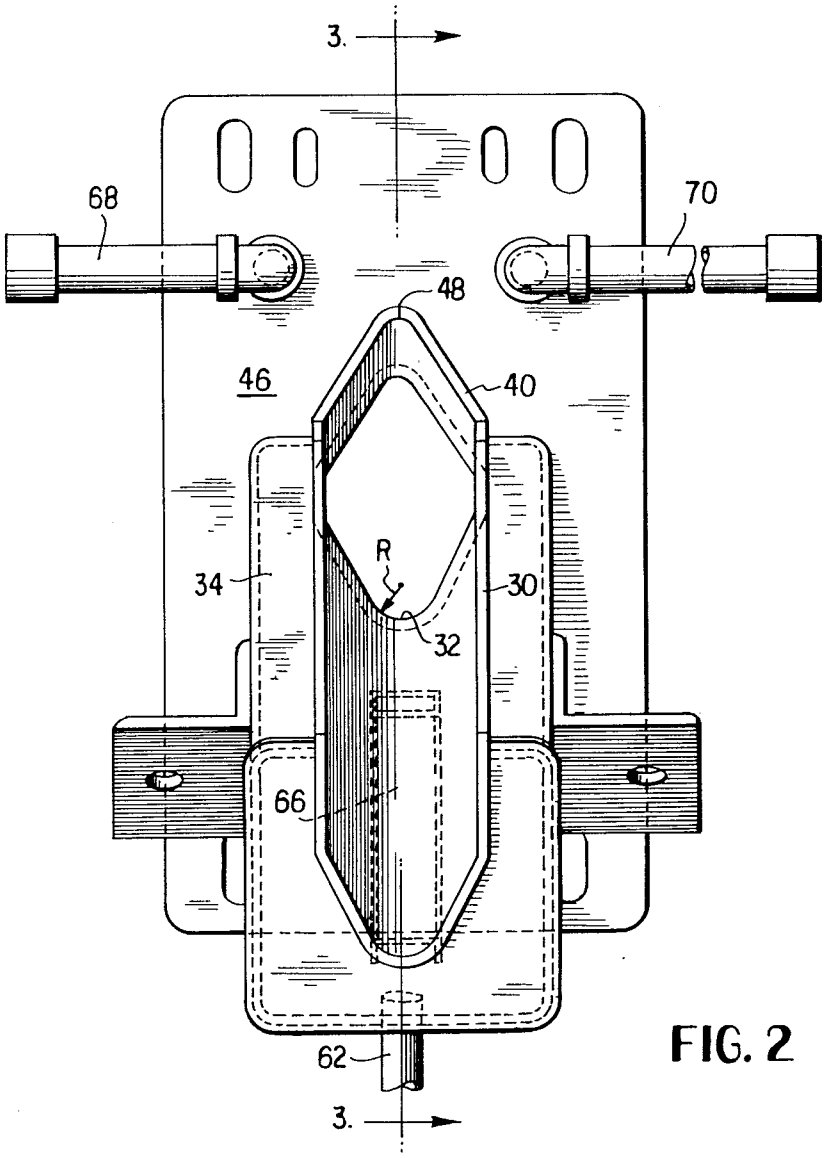
FIG. 2 is a front view of the boiler spout of this invention.
Figures 3, 4, 5:
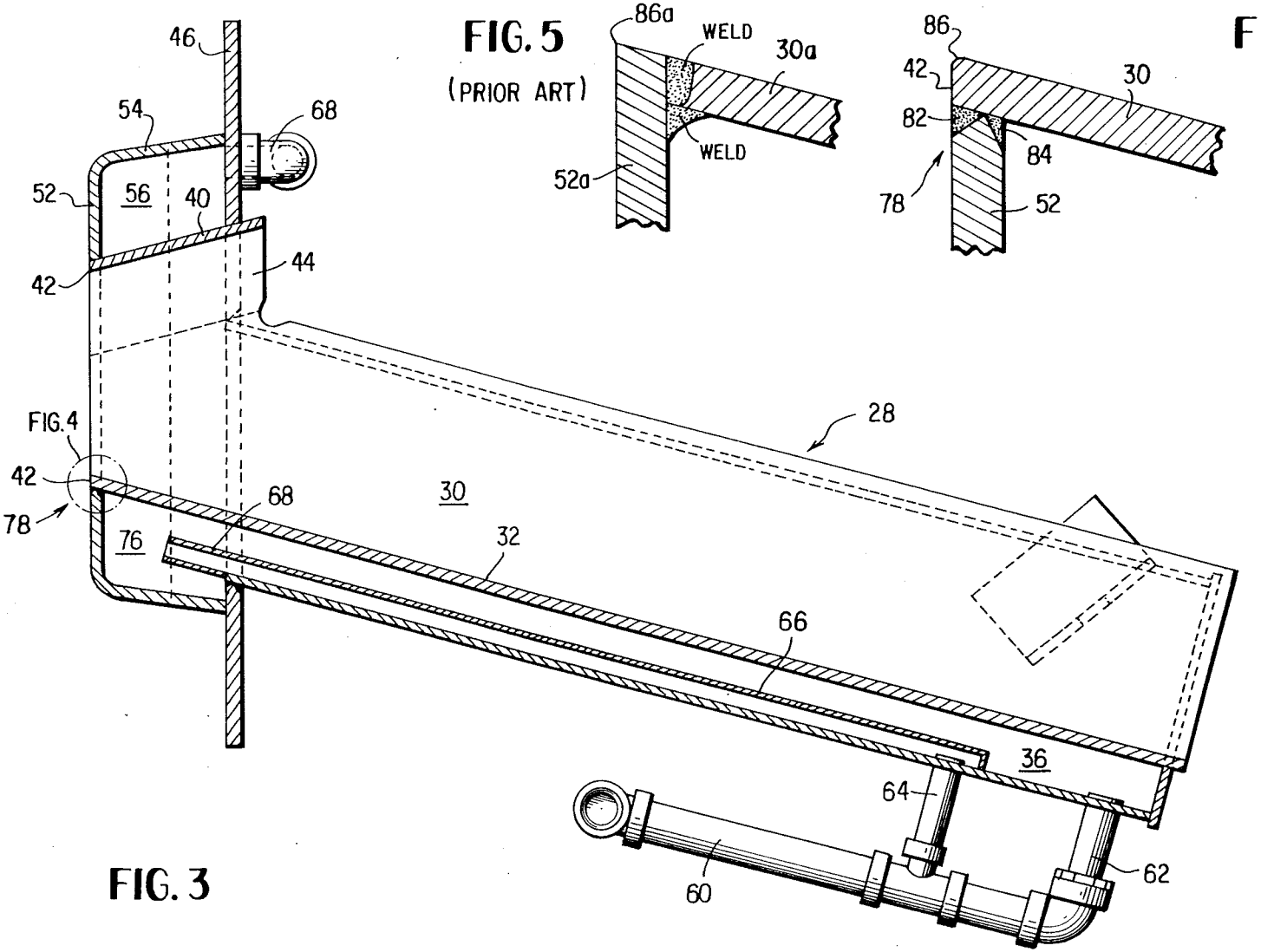
FIG. 5 (PRIOR ART)
FIG. 3 is a view taken along section 3—3 of FIG. 2.
FIG. 4 is an enlarged view of the circled portion of FIG. 3.
FIG. 5 is a view, similar to FIG. 4, showing a corresponding prior art construction.

Referring now to FIGS. 2 and 3 of the drawing, the numeral 28 denotes generally the boiler spout of this invention and includes a trough plate 30 through which the hot, caustic smelt passes. The bottom of the trough plate 30 is denoted by the numeral 32 and has a radius of curvature of approximately one inch, this radius denoted by R. From the bottommost portion of trough plate 30, the sides of the trough slope upwardly and curve somewhat, and then extend vertically upwardly. The numeral 34 denotes an outer, generally rectangular casing secured to trough plate 30 as indicated, the casing having a bottom wall and two upstanding side walls each having an overhanging portion joined to a respective upper edge of trough plate 30. Both the trough and outer casing or jacket 34 are formed from carbon steel or the like, typically ⅜ths inch in thickness. The rear portion of the spout includes an upstanding and annularly continuous closed end 40, this trough portion being defined by an upward continutation of the sides of trough plate 30, with the sides being formed toward each other and meeting.

Trough 30 and outer casing 34 define a first or forward coolant chamber denoted by the numeral 36.

An apertured, flat mounting plate 46 receives the closed trough end. A rear cover plate 52, generally dishshaped, is centrally apertured, its aperture receiving the left or rearmost edge of the closed end 40, with the forward edges of walls 54 of the rear cover plate welded to the rear (left) surface of mounting plate 46. There is thus a continuous annular cavity 56 defined by plate 52, walls 54, mounting plate 46, and the outer circumference of the rear portion 40 of the spout. Cavity 56 is termed a rear coolant cavity. The rearmost portion 42 of closed trough end 40 passes through the aperture in cover plate 52. The radially innermost edges of rearmost portion 42 are rounded, as indicated by 86 at FIG. 4. The uppermost, forwardmost part of closed end 40, denoted by 44, extends forwardly of mounting plate 46.

The numerals 60, 62 and 64 denote inlet pipes for a coolant liquid, such as water. Supply pipe 60 supplies both of pipes 62 and 64, with the input from pipe 62 feeding the forward coolant cavity 36 and rear coolant chamber 56. The coolant liquid is withdrawn from the interior cavities 36, 56 by means of outlet ducts 68 and 70. Typically, the temperature of the inlet cooling water is 120 degrees F. and its outlet temperature is 140 degrees F., with a flow rate through the hollow spout of about 265 gallons per minute.

Duct 66, in a practical embodiment of the invention, was formed by welding a three-sided strut to the interior bottom of jacket 34, to thus form a four-sided passageway or duct, then adding, by welding, a four-sided duct portion 68.

Inlet duct 64 is coupled to the forward or lower end of directing duct 66, the rear end 68 of the latter directed at a zone designated by the numeral 76 in the lower portion of cavity 56. It has been determined that region 78, circled at FIG. 3 of the drawings, and shown magnified at FIG. 4, was subject to greater thermal fatigue than other portions of the spout assembly. The zone designated by the numeral 78 is the welded junction between the lower portion 32 of trough 30 and the lower portion of the aperture in cover plate 52.

As indicated at FIG. 4 it has been found that by providing a sharpened edge on the periphery of the opening in rear cover plate 52 which receives the rear end of closed trough end 40, and by welding the end 42 of closed end 40 to the interior rim of the opening in cover plate 52, as indicated by the numerals 82 and 84, thermal fatigue is lesser than with prior constructions. It is believed that the extended operating life enjoyed by the consruction of the present pour spout is due to directing a portion of the fluid coolant, by means of duct 66, to zone 76, and by the use of the specific weld joint indicated at FIG. 4. It will further be observed that the innermost portions around rim 42 of the closed trough end are rounded, as denoted by the numeral 86 at FIG. 4 this rounding having a radius of approximately ⅛ inch. This is in distinction to a typical prior art construction, wherein the region corresponding to point 86 of FIG. 4 was sharp,i.e., no radius at all was given, as indicated by the numeral **86*a* at FIG. 5**.

Figure 6:
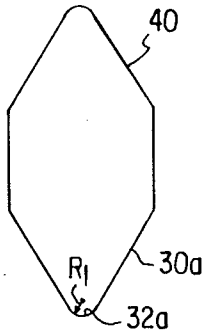
FIG. 6 (PRIOR ART)
FIG. 6 is a view illustrating a prior art contruction of the trough cross-section outline.

Further, in distinction to the construction shown at FIG. 4, the connection between rear cover plate 52 and the closed trough end 40 was made by joining the left end of the closed end 32, to plae 52 in a manner shown in FIG. 5 namely, the hot, molten smelt first contacted the rear cover plate 52 prior to contacting the trough 30. The subscript "a" is shown at FIG. 5 for corresponding elements 30 and 52 of FIG. 4. The construction shown at FIG. 4 is also believed to extend the operating life of the present smelt spout. FIG. 6 shows a prior art trough section, the radius of the lower portions **32*a* of trough 30*a*** being indicated by $R_1$ and was typically ⅜ inch.

We claim:

1. A water cooled spout, adapted to be used in the furnace of a recovery boiler, the spout having a forward portion and a rear portion, the spout having a trough and a jacket connected to the trough to define a forward coolant chamber, the rear of the trough having sides which extend upwardly and toward each other to define a closed end, a mounting plate against which one portion of said closed trough end abuts, a rear, dish-shaped cover plate having an aperture which receives the rear end of said closed trough end, the walls of said dish-shaped rear cover plate surrounding said trough closed end and whose edges abut said mounting plate, the walls of said losed trough and said rear cover plate defining a rear coolant chamber communicating with said forward coolant chamber, means for supplying a coolant liquid into and out of said coolant cavities, a directing duct having one end directed at a lower portion of said rear coolant chamber, means for supplying a coolant liquid to said directing duct, whereby coolant liquid exiting from said directing duct inhibits stagnation of the coolant liquid in the lower end of said rear coolant chamber and thereby inhibits thermal fatigue.

2. The spout of claim 1 wherein said directing duct extends from said rear coolant chamber to said forward coolant chamber.

3. The spout of claim 1 wherein the radius of curvature of the lowermost part of said trough is about one inch.

4. The spout of claim 1 wherein the rear edge of the closed end of said trough extends through said opening in said dish-shaped rear cover plate.

5. The spout of claim 4 wherein the edge of the peripheral opening in the rear cover plate is beveled on both sides and wherein weld material fills said bevels.

6. The spout of claim 4 wherein the radially innermost edge of the rear portion of said closed trough end is rounded to a radius of about one-eighth inch.

7. The spout of claim 1 wherein the forwardmost, uppermost portion of said closed trough end extends forwardly of said mounting plate.

* * * * *